US010177456B2

(12) United States Patent
Chauloux et al.

(10) Patent No.: US 10,177,456 B2
(45) Date of Patent: Jan. 8, 2019

(54) LOG-PERIODIC ANTENNA WITH WIDE FREQUENCY BAND

(71) Applicant: COMMISSARIAT A L'ENERGIE ATOMIQUE ET AUX ENERGIES ALTERNATIVES, Paris (FR)

(72) Inventors: Antoine Chauloux, Rennes (FR); Mohamed Himdi, Rennes (FR); Franck Colombel, Montfort sur Meu (FR)

(73) Assignee: COMMISSARIAT A L'ENERGIE ATOMIQUE ET AUX ENERGIES ALTERNATIVES, Paris (FR)

( * ) Notice: Subject to any disclaimer, the term of this patent is extended or adjusted under 35 U.S.C. 154(b) by 184 days.

(21) Appl. No.: 15/328,708

(22) PCT Filed: Jul. 30, 2015

(86) PCT No.: PCT/EP2015/067490
§ 371 (c)(1),
(2) Date: Jan. 24, 2017

(87) PCT Pub. No.: WO2016/016361
PCT Pub. Date: Feb. 4, 2016

(65) Prior Publication Data

US 2017/0222324 A1 Aug. 3, 2017

(30) Foreign Application Priority Data

Jul. 31, 2014 (FR) ..... 14 57419

(51) Int. Cl.
*H01Q 11/10* (2006.01)
*H01Q 1/08* (2006.01)
(Continued)

(52) U.S. Cl.
CPC ..... *H01Q 11/105* (2013.01); *H01Q 1/085* (2013.01); *H01Q 1/48* (2013.01); *H01Q 1/523* (2013.01);
(Continued)

(58) Field of Classification Search
CPC ..... H01Q 11/10; H01Q 11/105; H01Q 1/48; H01Q 21/062
See application file for complete search history.

(56) References Cited

U.S. PATENT DOCUMENTS 3,249,946 A * 5/1966 Flanagan ..... H01Q 11/10 343/758
4,198,639 A * 4/1980 Killion ..... H01Q 11/10 343/727
(Continued)

FOREIGN PATENT DOCUMENTS

RU 2 485 643 C1 6/2013
WO WO 98/21779 A1 5/1998
(Continued)

OTHER PUBLICATIONS

International Search Report dated Oct. 6, 2015, in PCT/EP2015/067490 filed Jul. 30, 2015.
(Continued)

*Primary Examiner* — Dameon E Levi
*Assistant Examiner* — Jennifer F Hu
(74) *Attorney, Agent, or Firm* — Oblon, McClelland, Maier & Neustadt, L.L.P.

(57) ABSTRACT

A log-periodic antenna including one set of three radiating elements with log-periodic patterns, each radiating element including a succession of radiating dipoles distributed on either side of a rectilinear electrically conducting line, perpendicular to the line, a first radiating element having a rectilinear electrically conducting line substantially perpen-
(Continued)

dicular to the first face of the substrate, the first ends of the electrically conducting lines of the various radiating elements being substantially aligned along a direction parallel to the first face, the rectilinear electrically conducting lines of the second and third radiating elements being situated in a same plane as the rectilinear electrically conducting line of the first radiating element and inclined with respect to the electrically conducing line of the first radiating element, the radiating dipoles of the three radiating elements being substantially perpendicular to the plane which contains the rectilinear electrically conducting lines of the three radiating elements.

10 Claims, 6 Drawing Sheets

(51) Int. Cl.

| | |
|---|---|
| ***H01Q 1/52*** | (2006.01) |
| ***H01Q 21/24*** | (2006.01) |
| ***H01Q 1/48*** | (2006.01) |
| ***H01Q 3/04*** | (2006.01) |
| ***H01Q 21/06*** | (2006.01) |

(52) U.S. Cl.
CPC ..... *H01Q 3/04* (2013.01); *H01Q 11/10* (2013.01); *H01Q 21/062* (2013.01); *H01Q 21/24* (2013.01)

(56) References Cited

U.S. PATENT DOCUMENTS

| | | | | |
|---|---|---|---|---|
| 5,917,455 | A * | 6/1999 | Huynh | H01P 1/184 333/161 |
| 6,094,176 | A | 7/2000 | Van Hoozen et al. | |
| RE44,332 | E | 7/2013 | Mailandt et al. | |
| 2003/0016181 | A1* | 1/2003 | Engargiola | H01Q 11/04 343/792.5 |
| 2006/0202900 | A1* | 9/2006 | Simile | H01Q 11/10 343/792.5 |
| 2007/0262912 | A1* | 11/2007 | Eckwielen | H01Q 1/1228 343/818 |
| 2009/0212990 | A1* | 8/2009 | Cloutier | G01S 13/32 342/22 |
| 2011/0148729 | A1* | 6/2011 | Ro | H01Q 11/06 343/792.5 |

FOREIGN PATENT DOCUMENTS

| | | | |
|---|---|---|---|
| WO | WO 00/31826 | A1 | 6/2000 |
| WO | WO 2006/096402 | A2 | 9/2006 |

OTHER PUBLICATIONS

French Search Report dated Mar. 19, 2015, in French Application 1457419 filed Jul. 31, 2014.

* cited by examiner

LOG-PERIODIC ANTENNA WITH WIDE FREQUENCY BAND

TECHNICAL FIELD AND PRIOR ART

The invention relates to a very wide frequency band antenna and, more particularly, a log-periodic antenna with a wide frequency band.

Maintaining the radioelectric characteristics of antennas on a very wide frequency band is a permanent issue in the communication field. The same is true, for example, of the maintenance of a constant illumination on a wide frequency band.

Different configurations are known from prior art for maintaining a constant illumination on a wide frequency band. Among these configurations are included, for example, travelling wave antennas (Vivaldi antennas, with wave guides with grooves, etc.), reflector antennas, antenna arrays provided with circuits for processing phase and amplitude of signals transmitted/received by the antenna, etc. The frequency bandwidth can then reach several decades.

One problem of these configurations is however their bulkiness. Indeed, the antennas concerned have, in the direction of propagation of the waves, a dimension which is in the order of magnitude of the wavelength which corresponds to the lowest frequency. To make systems with a reduced bulkiness, for example embedded systems, this is a drawback.

The invention does not have this drawback.

DISCLOSURE THE INVENTION

Indeed, the invention relates to a log-periodic antenna which comprises at least one set of three radiating elements with log-periodic patterns and a substrate which defines an electrical ground of the antenna, the radiating elements with log-periodic patterns being positioned above a first face of the flat substrate, each radiating element with log-periodic patterns comprising a succession of radiating dipoles distributed on either side of a rectilinear electrically conducting line, perpendicularly to said line, the radiating dipoles having a dimension which increases between a first end of said line and a second end of said line situated nearer to said first face than the first end, a first radiating element having a rectilinear electrically conducting line substantially perpendicular to said first face of the substrate, a second radiating element and a third radiating element being situated on either side of the first radiating element, symmetrically to the first radiating element, the first ends of the electrically conducting lines of the different radiating elements being separated from each other and substantially aligned along a direction parallel to the first face, the rectilinear electrically conducting lines of the second and third radiating elements being situated in a same plane as the rectilinear electrically conducting line of the first radiating element and being inclined with respect to the electrically conducting line of the first radiating element such that the first ends of the rectilinear electrically conducting lines of the second and third radiating elements are nearer than the second ends of the rectilinear electrically conducting lines of said second and third radiating elements, the radiating dipoles of the three radiating elements being either substantially perpendicular to the plane which contains the rectilinear electrically conducting lines of the three radiating elements, or substantially in the plane which contains the rectilinear electrically conducting lines of the three radiating elements.

According to a further characteristic of the invention:

the distance between the radiating dipole with the lowest dimensions of the second radiating element and the radiating dipole with the lowest dimensions of the first radiating element and the distance between the radiating dipole with the lowest dimensions of the third radiating element and the radiating dipole with the lowest dimensions of the first radiating element are substantially between $0.6\lambda_{HF}$ and $0.7\lambda_{HF}$, where $\lambda_{HF}$ is a wavelength of a high frequency wave radiated by the log-periodic antenna, and the distance between the radiating dipole with the greatest dimensions of the second radiating element and the radiating dipole with the greatest dimensions of the first radiating element and the distance between the radiating dipole with the greatest dimensions of the third radiating element and the radiating dipole with the greatest dimensions of the first radiating element are substantially between $0.6\lambda_{BF}$ and $0.7\lambda_{BF}$, where $\lambda_{BF}$ is a wavelength of a low frequency wave radiated by the log-periodic antenna.

According to another further characteristic of the invention, each radiating element consists of a flat dielectric substrate on which the log-periodic patterns are printed on either side of the flat dielectric substrate.

According to yet another further characteristic of the invention, each planar radiating element comprises six radiating dipoles positioned between the first end and the second end, the six radiating dipoles being arranged such that, from the first end:

a first radiating dipole consists of first and second tracks with a length $L\times\tau^5$, L being the length of the first and second tracks of the sixth dipole and $\tau$ being a coefficient lower than 1;

a second radiating dipole situated at a distance $D\times\tau^4$ from the first dipole has first and second tracks with to length $L\times\tau^4$;

a third radiating dipole situated at a distance $D\times\tau^3$ from the second dipole has first and second tracks with a length $L\times\tau^3$;

a fourth radiating dipole situated at a distance $D\times\tau^2$ from the third dipole has first and second tracks with a length $L\times\tau^2$;

a fifth radiating dipole situated at a distance $D\times\tau$ from the fourth dipole has first and second tracks with a length $L\times\tau$;

a six radiating dipole which has first and second tracks with a length L is situated at a distance D from the fifth dipole.

According to yet another further characteristic of the invention, the flat dielectric substrate has a thickness of 0.8 mm and a relative dielectric constant equal to 3, the width of the first and second tracks of the different radiating dipoles is equal to 5 mm, the quantities L and D are respectively equal to 70 mm and 15.77 mm and the coefficient $\tau$ is equal to 0.824.

According to yet another further characteristic of the invention, the log-periodic antenna comprises means for supplying the first ends of the electrically conducting lines of the different radiating elements with electromagnetic waves the electric field vectors of which have a direction parallel to the axis of the radiating dipoles.

According to yet another further characteristic of the invention, the means for supplying the first ends of the electrically conducting lines comprise a power divider attached to an electrically conducting face of the substrate which is opposite the face above which the radiating elements are situated.

According to yet another further characteristic of the invention, when the log-periodic antenna comprises at least two sets of three radiating elements and that the radiating dipoles of the three radiating elements of a same set of three radiating elements are substantially perpendicular to the plane which contains the rectilinear electrically conducting lines of the three radiating elements, the first faces of the substrates which define the electrical grounds of the log-periodic antennas are situated in a same plane, the planes which contain the rectilinear electrically conducting lines of the different sets of three radiating elements are parallel to each other and the rectilinear electrically conducting lines of the first radiating elements of the different sets of three radiating elements are situated in a same plane.

According to yet another further characteristic of the invention, when the log-periodic antenna comprises at least two sets of three radiating elements, and the radiating dipoles of the three radiating elements of a same set of radiating elements are in the plane which contains the rectilinear electrically conducting lines of the three radiating elements, the first faces of the substrates which define the electrical grounds of the log-periodic antennas are situated in a same plane, the planes which contain the rectilinear electrically conducting lines of the different sets of three radiating elements are parallel to each other and the rectilinear electrically conducting lines of the first radiating elements of the different sets of three radiating elements are situated in a same plane.

According to yet another further characteristic of the invention, the electrically conducting substrates which define the electrical grounds of two neighbouring log-periodic antennas are electrically connected to each other by an extensible metal meshing enabling two sets of three neighbouring radiating elements to be moved away or nearer.

BRIEF DESCRIPTION OF THE FIGURES

Further characteristics and advantages of the invention will appear upon reading a preferential embodiment made in reference to the appended figures, in which.

Throughout the figures, the same references designate the same elements.

DETAILED DISCLOSURE OF EMBODIMENTS OF THE INVENTION

Figure 1:
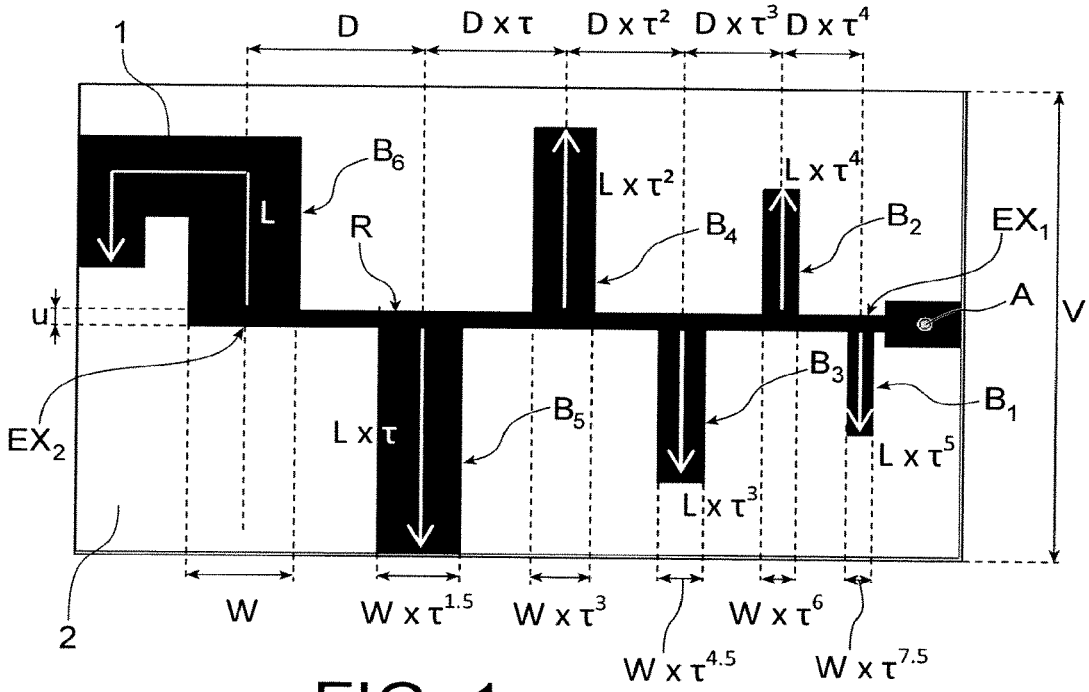
FIG. 1 represents an exemplary radiating element which is involved in a wide band log-periodic antenna of the invention.

FIG. 1 represents an exemplary radiating element which is involved in the wide band log-periodic antenna of the invention.

The radiating element consists of an electrically conducting log-periodic pattern 1 symmetrically printed on both opposite faces of a flat dielectric substrate 2.

FIG. 1 is a top view of a face of the dielectric substrate 2. On each of both opposite faces of the dielectric substrate 2, the printed log-periodic pattern comprises, by way of non-limiting example, six arms $B_1$-$B_6$ distributed on either side of a centre rectilinear track R. The arms $B_1$-$B_6$ are perpendicular to the track R. In a known manner per se, two arms situated facing each other, on either side of the dielectric substrate 2, make up a radiating dipole.

Arms $B_1$-$B_6$ are distributed on either side of the track R, between a first end $EX_1$ and a second end $EX_2$ of the track R, which is opposite the first end. From the first end to the second end of the track R, there are:

- a first arm $B_1$ with a length $L\times\tau^5$ situated on a first side of the track R, in the proximity of a point A with which the radiating element is supplied, $\tau$ being a scale factor lower than 1,
- a second arm $B_2$ with a length $L\times\tau^4$ situated, on the side of the track which is opposite the first side, at a distance equal to $D\times\tau^4$ from the first arm,
- a third arm $B_3$ with a length $L\times\tau^3$ situated, on the first side of the track, at a distance equal to $D\times\tau^3$ from the second arm,
- a fourth arm $B_4$ with a length $L\times\tau^2$ situated, on the side of the track which is opposite first side, at a distance equal to $D\times\tau^2$ from the third arm,
- a fifth arm $B_5$ with a length $L\times\tau$ situated, on the first side of the track, at a distance equal to $D\times\tau$ from the fourth arm, and
- a sixth arm $B_6$ with a length L situated, on the side of the track which is opposite the first side.

Figure 2A:
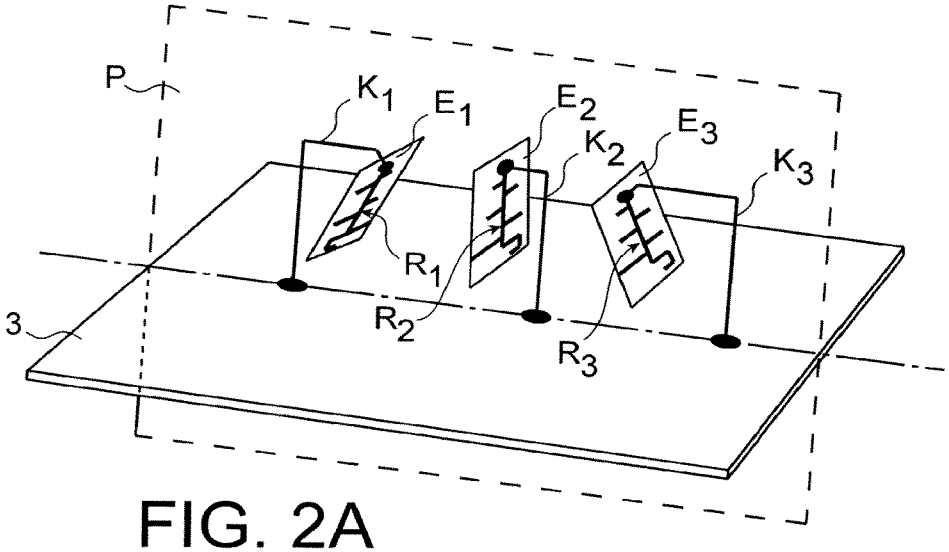
FIGS. 2A and 2B respectively represent a perspective view and a side view of an exemplary wide band log-periodic antenna according to a first embodiment of the invention.
Figure 2B:
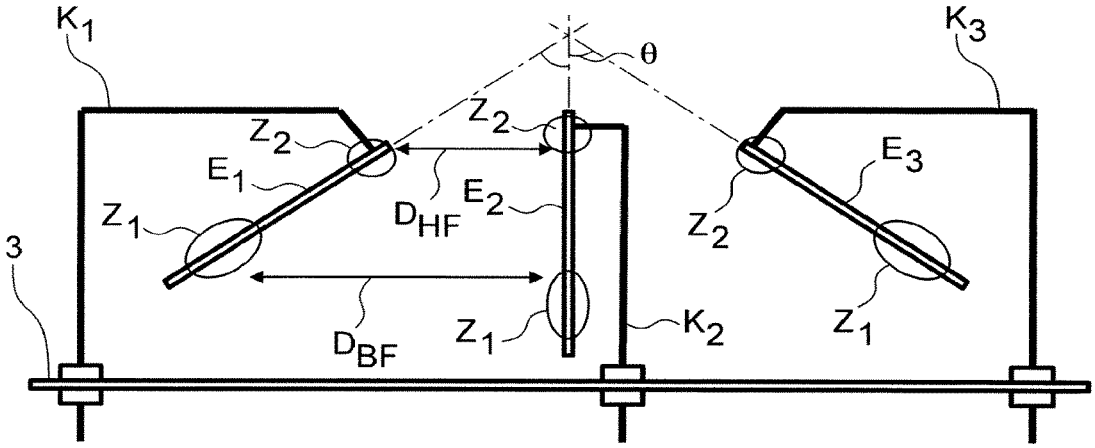

Arm B6 which has the greatest length is preferentially folded in order to limit the interaction of the radiating element with the ground plane on which the radiating element is positioned (cf. FIGS. 2A and 2B). Track R has, for example, a width U equal to 1.5 mm.

The radiating element is optimized, for example, in the frequency band 2 GHz-4 GHz. The dielectric substrate 2 has, for example, a thickness equal to 0.8 mm and, for example, a relative dielectric constant $\varepsilon_r$ equal to 3. The scale factor $\tau$ is preferentially between 0.7 and 0.9. It is, for example, equal to 0.824. By way of non-limiting example also, the quantity D is equal to 15.77 mm and the quantity L is equal to 70 mm. The widths of the arms $B_1$-$B_6$ are respectively equal to $W\times\tau^{7.5}$, $W\times\tau^6$, $W\times\tau^{4.5}$, $W\times\tau^3$, $W\times\tau^{1.5}$ and W, the quantity W being equal, for example, to 5 mm. Preferentially, the width V of the dielectric substrate 2 is such that:

$$V=U+2\times L\times\tau$$

The exemplary numerical values mentioned above clearly show that the different elements which make up FIG. 1 are not drawn to scale. The geometry of this figure has indeed been chosen with the single purpose of favouring a good visibility of these different elements, without taking their real scale into account.

FIGS. 2A and 2B respectively represent a perspective view and a side view of a wide band log-periodic antenna according to the first embodiment of the invention.

The wide band log-periodic antenna comprises three radiating elements $E_1$, $E_2$, $E_3$ situated above a first face of a planar electrically conducting substrate 3 which defines the electrical ground of the antenna. The substrates of the radiating elements $E_1$ and $E_3$ are situated on either side of the radiating element $E_2$, symmetrically to the substrate of the radiating element $E_2$. The centre rectilinear track $R_2$ of the centre radiating element $E_2$ is perpendicular to the first face of the electrically conducting substrate 3. The three radiating elements are arrayed such that the rectilinear tracks $R_1$, $R_2$ and $R_3$ of the three radiating elements are situated in a same plane P which is the plane H of the radiating elements. As a result, the arms of the radiating dipoles of the different radiating elements are parallel to each other. As is known to those skilled in the art, the plane H of an antenna is, by definition, the plane that contains the direction of propagation of the wave radiated by the antenna and the direction of the magnetic field of the radiated wave. Likewise, by definition, the plane E of an antenna is the plane which contains the direction of propagation of the wave radiated by the antenna and the direction of the electric field of the radiated wave.

The first ends of the centre rectilinear tracks $R_1$, $R_2$ and $R_3$ are separated from each other and substantially aligned in a plane parallel to the electrically conducting substrate 3, the first ends of the rectilinear tracks $R_1$ and $R_3$ being nearer to each other than the second ends of these same tracks are.

The three radiating elements $E_1$, $E_2$ and $E_3$ are connected, at the first ends of the respective tracks $R_1$, $R_2$ and $R_3$, to three respective coaxial cables $K_1$, $K_2$, $K_3$. The core and the electrically conducting sheath of a coaxial cable are electrically connected to the printed patterns which are respectively situated on either side of a dielectric substrate of a radiating element. The electrically conducting sheath is welded to the printed pattern of a first face of the radiating element, whereas the core is electrically contacted with the printed pattern on the other side, for example by welding. A boring of the dielectric substrate is thus performed at the first end of the track of each radiating element for the coaxial cable core to pass therethrough. A rectangular electrically conducting chip can be added to the interface between the printed pattern on the first face and the sheath of the coaxial cable, for the purpose of promoting the electrical contact.

According to the preferential embodiment of the invention, the coaxial cables $K_i$(i=1, 2, 3) are welded on copper washers, the latter being screwed to the electrically conducting substrate 3.

Preferentially, the coaxial cables $K_1$ and $K_3$ are mounted outside the space situated between the radiating elements $E_1$ and $E_3$ and the coaxial cable $K_2$ is positioned between the radiating elements $E_2$ and $E_3$.

Figure 3A:
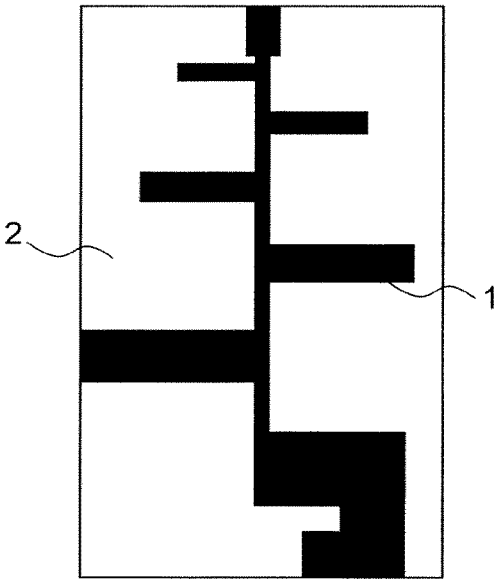
FIGS. 3A and 3B represent mirror radiating elements used in an advantageous configuration of the first embodiment of the invention.
Figure 3B:
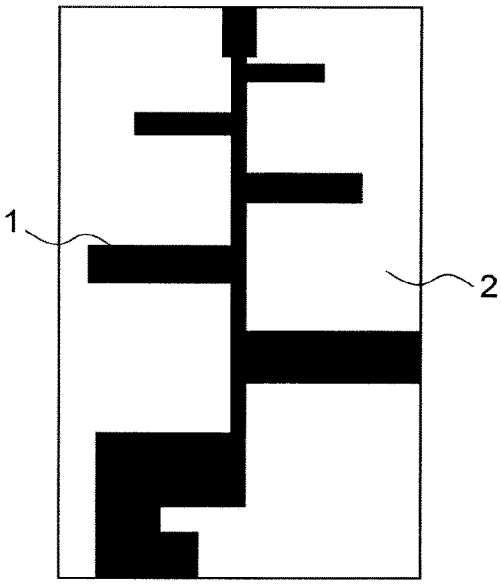

The signals radiated by the three radiating elements must be in phase. As a result, the log-periodic pattern of the radiating element $E_1$ is a mirror pattern with respect to the patterns of the other two radiating elements $E_2$ and $E_3$. Two mirror patterns of each other are represented in FIGS. 3A and 3B. Thus, if FIG. 3A represents a top view of the log-periodic pattern of the radiating elements $E_2$ and $E_3$ which is electrically connected to the core of respective coaxial cables $K_2$ and $K_3$, FIG. 3B represents the top view of the log-periodic pattern of the radiating element $E_1$ which is also connected to the core of the coaxial cable $K_1$.

The distance that separates each of the radiating elements $E_1$, $E_3$ from the centre element $E_2$ is determined by the ratio of the distances between the active zones of the radiating elements, which ratio is inversely proportional to the ratio of the operating frequencies.

As a result:

$$D_{BF}/D_{HF}=F_H/F_B, \text{ where}$$

$D_{BF}$ is the distance which separates the radiating dipoles of the radiating element Ej (j=1, 3) which transmit the wave with the lowest frequency $F_B$ from the radiating dipoles of the radiating element E2 which also transmit the wave with the lowest frequency $F_B$, $D_{HF}$ is the distance which separates the radiating dipoles of the radiating element Ej (j=1, 3) which transmit the wave with the highest frequency $F_H$ from the radiating dipoles of the radiating element E2 which also transmit the wave with the highest frequency $F_H$.

Indeed, all the dipoles of the log-periodic pattern are not simultaneously active. For the operation of the antenna system at the lowest frequencies, the transmission zone $Z_1$ of a radiating element is situated on the dipoles having a great size whereas, for the operation of the antenna system at the highest frequencies, the transmission zone $Z_2$ is situated on the dipoles with a small size. The transmission zone is thereby different depending on whether the transmission frequency is more or less high.

According to the invention, the distance $D_{BF}$ which separates both transmission zones $Z_1$ from two neighbouring radiating elements is substantially equal to $0.65\lambda_{BF}$ and the distance $D_{HF}$ which separates both transmission zones $Z_2$ from two neighbouring elements is substantially equal to $0.65\lambda_{HF}$, the quantities $\lambda_{BF}$ and $\lambda_{HF}$ being respectively the vacuum wavelength which corresponds to the lowest transmission frequency transmitted by the antenna system and the vacuum wavelength which corresponds to the highest transmission frequency transmitted by the antenna system. It is an advantage of the invention to provide a small size structure.

According to the preferential embodiment of the invention, the useful frequency band is between 2 GHz and 4 GHz. The distance $D_{BF}$ between the transmission zones $Z_1$ of two neighbouring radiating elements is written as:

$$D_{BF}=0.65\times150 \text{ mm, that is}$$

$$D_{BF}=97.5 \text{ mm}$$

Likewise, the distance $D_{HF}$ between the transmission zones $Z_2$ of two neighbouring radiating elements is written as:

$$D_{HF}=0.65\times75 \text{ mm, that is}$$

$$D_{BF}=48.75 \text{ mm}$$

The distance that separates the radiating elements from the ground plane is on the other hand chosen to ensure a good working order of the antenna. By way of non-limiting example, the distance which separates the radiating element $E_2$ from the ground plane 3 is between 2 mm and 5 mm.

Particularly advantageously, for the antenna described above, a 3-dB beam width between 25° and 28° has been observed throughout the 2 GHz-4 GHz frequency band.

Figure 4:
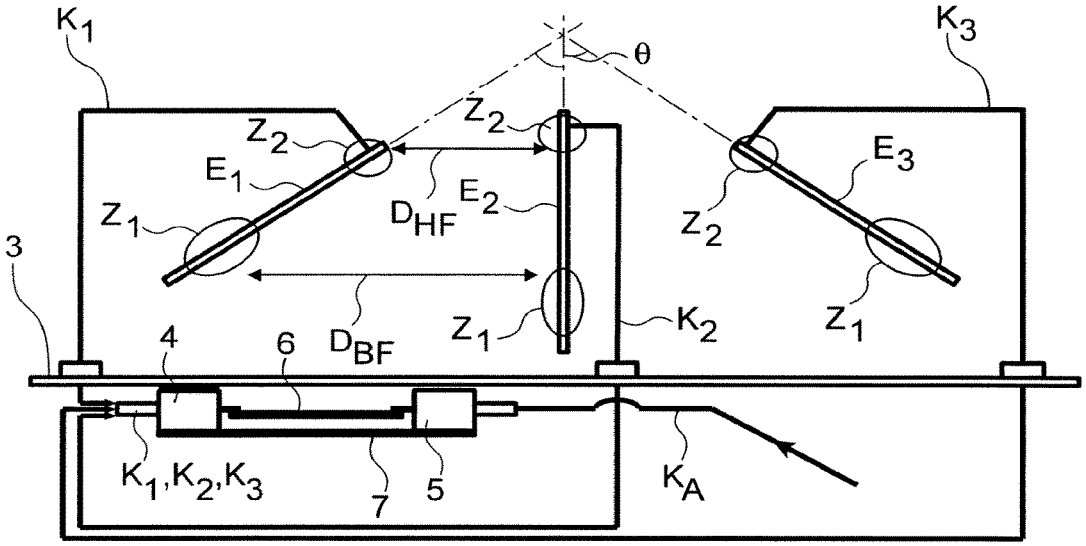
FIG. 4 represents a side view of an exemplary wide band log-periodic antenna equipped with a power divider, according to the first embodiment of the invention.
Figure 5A:
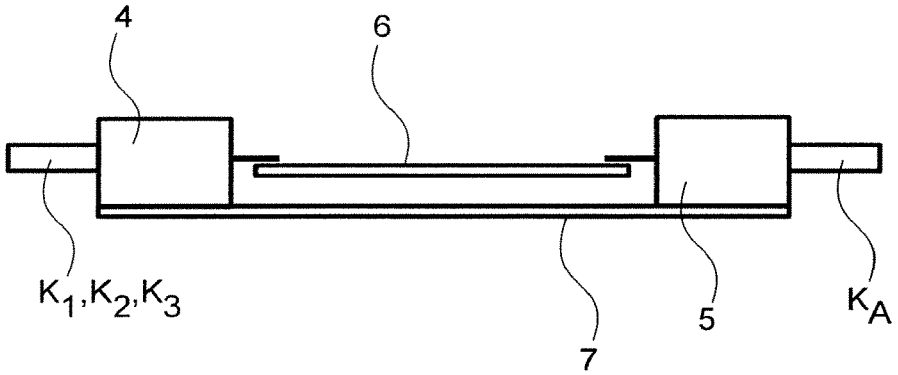
FIGS. 5A and 5B respectively represent a side view and a perspective exploded view, of the power divider represented in FIG. 4.
Figure 5B:
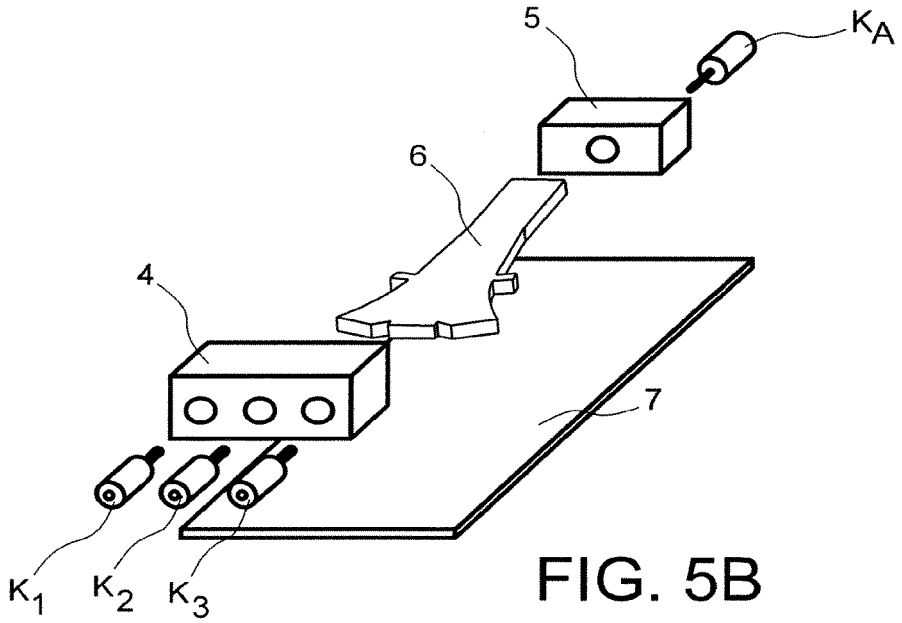

FIG. 4 represents a side view of a wide band antenna of the invention equipped with a power divider. FIGS. 5A and 5B respectively represent a side view and a perspective exploded view of the power divider represented in FIG. 4.

According to the example represented in FIG. 4, the power divider is attached to the substrate 3 and it is designed in air in order to ensure a high power operation. The invention also relates to other embodiments for which a power divider is not formed in air and/or is not attached to the substrate 3.

The power divider consists of a copper pattern 6 placed facing a ground plane 7. The power divider delivers three in-phase electromagnetic waves from an electromagnetic wave it receives on its input. The three outputs of the power divider are connected to the respective coaxial cables $K_1$, $K_2$, $K_3$. The input of the power divider 6 is connected, via a coaxial cable $K_4$, to a source which transmits the electromagnetic wave to be radiated (source not represented in the figures). The lengths of the cables $K_1$, $K_2$, $K_3$ are adjusted such that the waves received by the radiating elements are in-phase. Metal pads 4, 5 attach the copper pattern 6 and the ground plane 7 which make up the power divider on the face of the ground plane 3 which is opposite the first face.

In the embodiment of the invention described above in reference to FIGS. 4 and 5A-5B, the electromagnetic waves which supply the first ends of the conducting lines $R_1$, $R_2$, $R_3$ are in-phase and come from a same source. As a result, there is an antenna radiation diagram the axis of the main lobe of which is aligned along the conducting line $R_2$.

In another embodiment of the invention, the first ends of the conducting lines $R_1$, $R_2$, $R_3$ are supplied with electromagnetic waves the phases of which can vary independently of each other. As a result, there is an antenna radiation diagram the axis of the main lobe of which varies as a function of the phase shifts existing between the phases of the electromagnetic waves which supply the conducting lines $R_1$, $R_2$, $R_3$.

Figure 6:
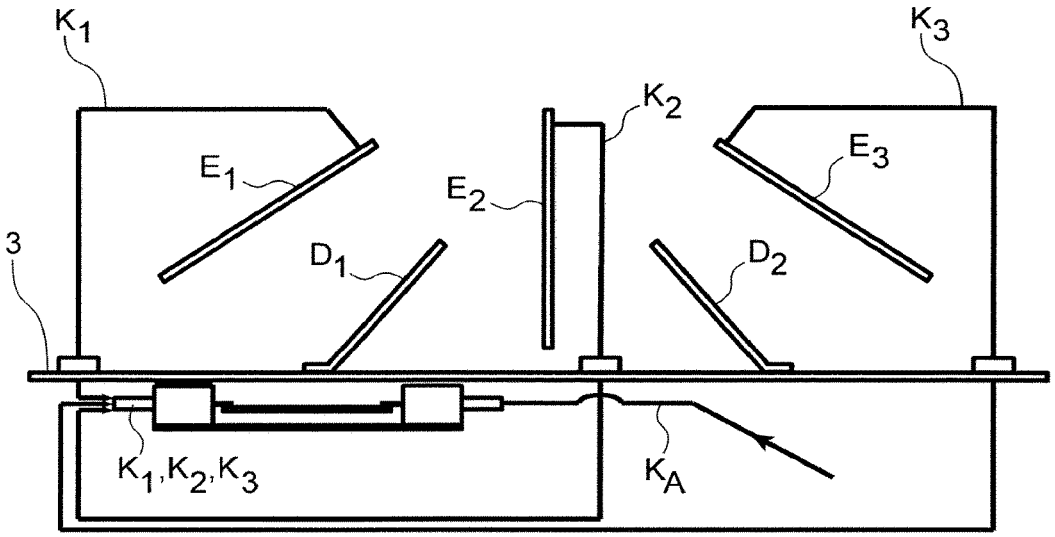
FIG. 6 represents an improvement of the wide band log-periodic antenna of the invention represented in FIG. 4.

FIG. 6 represents an improvement of the antenna system according to the invention.

In addition to the elements described in reference to FIGS. 2A-2B, the system of FIG. 6 comprises two metal deflectors $D_1$, $D_2$ attached to the ground plane 3. The deflectors $D_1$, $D_2$ are positioned on either side of the centre radiating element $E_2$. They provide a better electromagnetic insulation of the radiating elements with respect to each other. The adaptation of the antenna system is improved thereby, which results in an improvement in the antenna gain.

Figure 7:
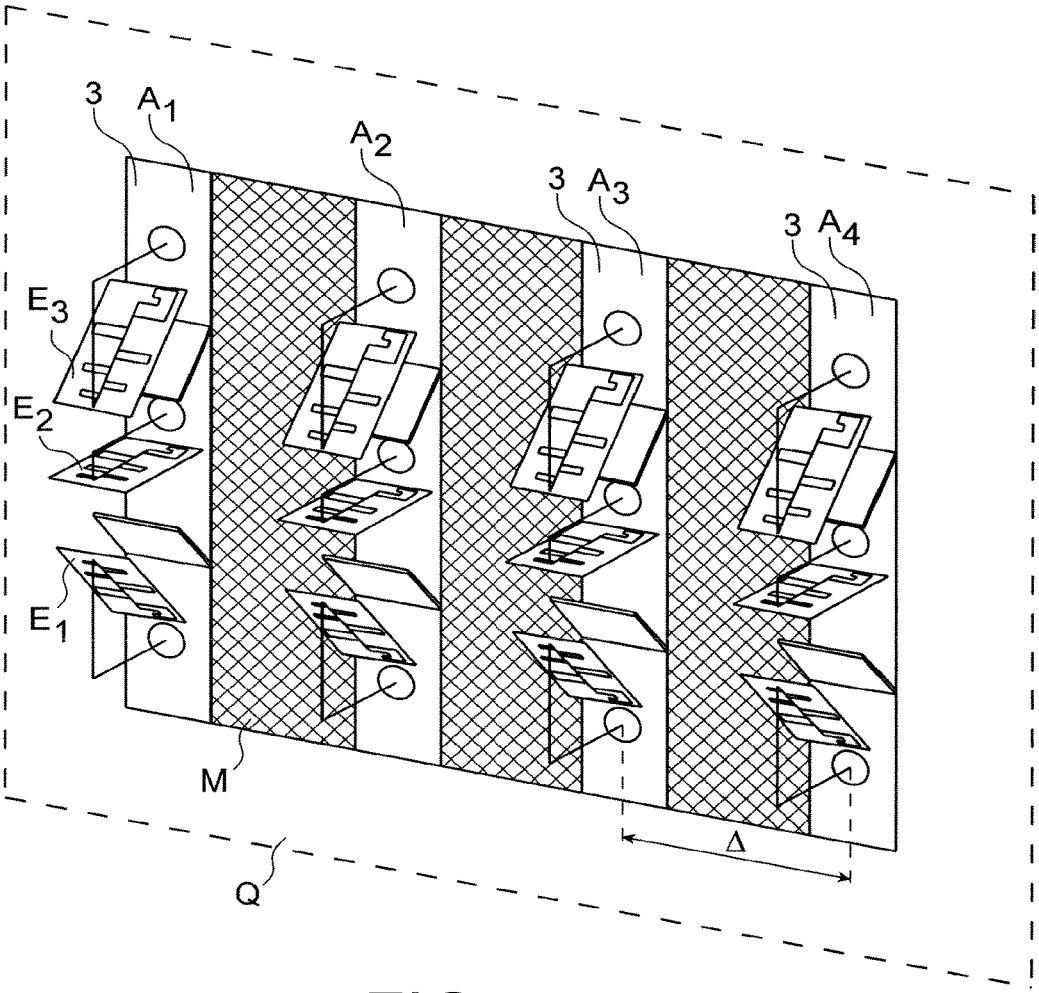
FIG. 7 represents an exemplary arraying of a plurality of wide band log-periodic antennas in accordance with the first embodiment of the invention.

FIG. 7 represents an exemplary arraying of a plurality of wide band log-periodic antennas in accordance with the first embodiment of the invention.

The wide band log-periodic antenna according to the first embodiment of the invention ensures maintenance of a constant radiation only in the plane H of the radiating elements making it up. FIG. 7 illustrates arraying of a plurality of wide band antennas in the plane E of the radiating elements. The antenna which results from this arraying advantageously keeps a constant radiation not only in the plane H, but also in the plane E.

The antenna represented in FIG. 7 consists, by way of non-limiting example, of four wide band log-periodic antennas $A_1$, $A_2$, $A_3$, $A_4$ in accordance with the antenna represented in FIG. 6. The electrically conducting substrates 3 of the different antennas $A_1$-$A_4$ are situated in a same plane Q. The radiating dipoles of the centre radiating elements $E_2$ of the different antennas $A_1$-$A_4$ are also situated in a same plane perpendicular to the plane Q and which is the plane E of the centre radiating elements $E_2$. A same distance Δ separates the centre rectilinear tracks $R_2$ of two neighbouring centre radiating elements $E_2$.

The distance Δ is chosen as a function of the operational frequency of the antenna. To that end, movable supports (not represented in the figure) enable the log-periodic antennas $A_1$-$A_4$ to be moved nearer or away. This modification in the distance Δ advantageously enables a constant illumination of the antenna which results from the association of the four unit antennas $A_1$-$A_4$ to be ensured, that is an invariant angle of half-power beam width of the main lobe radiated by the antenna. By way of non-limiting examples, the distance Δ is equal to 135 mm for a transmission frequency equal to 2 GHz and to 67.5 mm for a transmission frequency equal to 4 GHz.

According to an improvement of the invention, an extensible electrically conducting meshing M is provided between the different substrates 3. This meshing enables a continuity of the electrical ground to be defined. It is able to be extended or retracted depending on the modifications in the distance Δ. Regardless of the extension of the meshing M, the size of a unit mesh is much lower than one tenth of the wavelength of the wave radiated for the electrically conducting substrates 3 and the metal meshing M to make up, for the wave radiated by the antenna, an electrically continuous ground plane.

Figure 8:
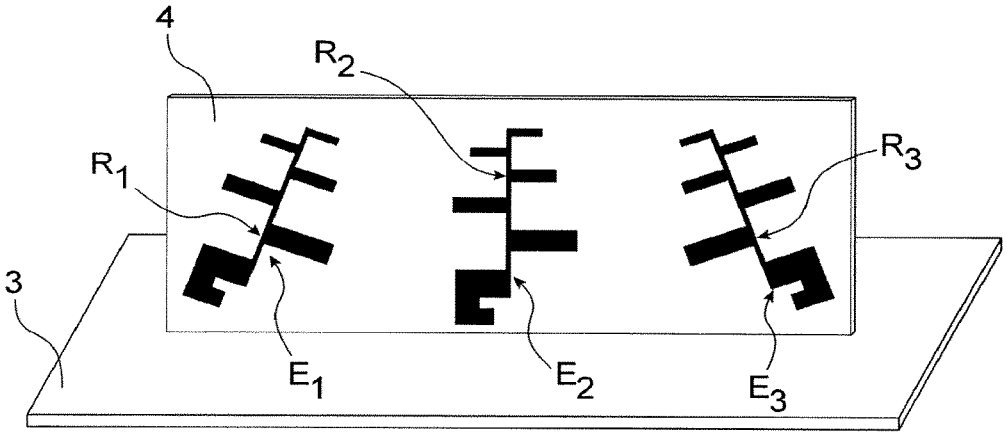
FIG. 8 represents a perspective view of an exemplary wide band log-periodic antenna according to a second embodiment of the invention.

FIG. 8 represents a top view of an exemplary wide band log-periodic antenna according a second embodiment of the invention.

According to the second embodiment of the invention, the log-periodic patterns of the three radiating elements $E_1$, $E_2$, $E_3$ are symmetrically printed on both opposite faces of a same flat dielectric substrate 4 which is parallel to the plane E of the radiating elements. The material which makes up the flat dielectric substrate 4 has, for example, a relative dielectric constant equal to 3 and a thickness equal to 0.8 mm.

The radiating element $E_2$ is central with respect to both other radiating elements $E_1$ and $E_3$. The rectilinear track $R_2$ of the radiating element $E_2$ is perpendicular to the electrically conducting substrate 3. The rectilinear tracks $R_1$ and $R_3$ of the respective radiating elements $E_1$ and $E_3$ are disposed on either side of the rectilinear track $R_2$, symmetrically to the rectilinear track $R_2$. The first ends of the rectilinear tracks $R_1$, $R_2$ and $R_3$ are substantially aligned along a straight line parallel to the electrically conducting substrate 3. In the same way as in the first embodiment of the invention, the rectilinear tracks $R_1$ and $R_3$ of the respective radiating elements $E_1$ and $E_3$ are inclined with respect to the track $R_2$ of the centre radiating element $E_2$ and the first ends of the rectilinear tracks $R_1$ et $R_3$ are nearer to each other than the second ends of these tracks are. The previous distances $D_{BF}$ and $D_{HF}$ given for the first embodiment of the invention are also valid in the second embodiment.

The radiating elements $E_1$, $E_2$, $E_3$ are connected to an electromagnetic wave source via coaxial cables and a power divider (not represented in the figure). Like in the first embodiment of the invention, the radiating elements $E_1$, $E_2$, $E_3$ are connected to the coaxial cables at the first ends of the respective tracks $R_1$, $R_2$, $R_3$ and the flat dielectric substrate 4 is attached to the electrically conducting substrate 3 via the coaxial cables. The substrate 4 is then held in position thanks to the rigidity of the coaxial cables. The dielectric substrate 4 is substantially perpendicular to the conducting substrate 3. The distance that separates the dielectric substrate 4 from the electrically conducting substrate 3 is between, for example, 2 mm and 5 mm. In the same way as in the first embodiment of the invention, the waves radiated by the different radiating elements are in-phase. The log-periodic patterns of the different radiating elements are disposed accordingly.

Figure 9:
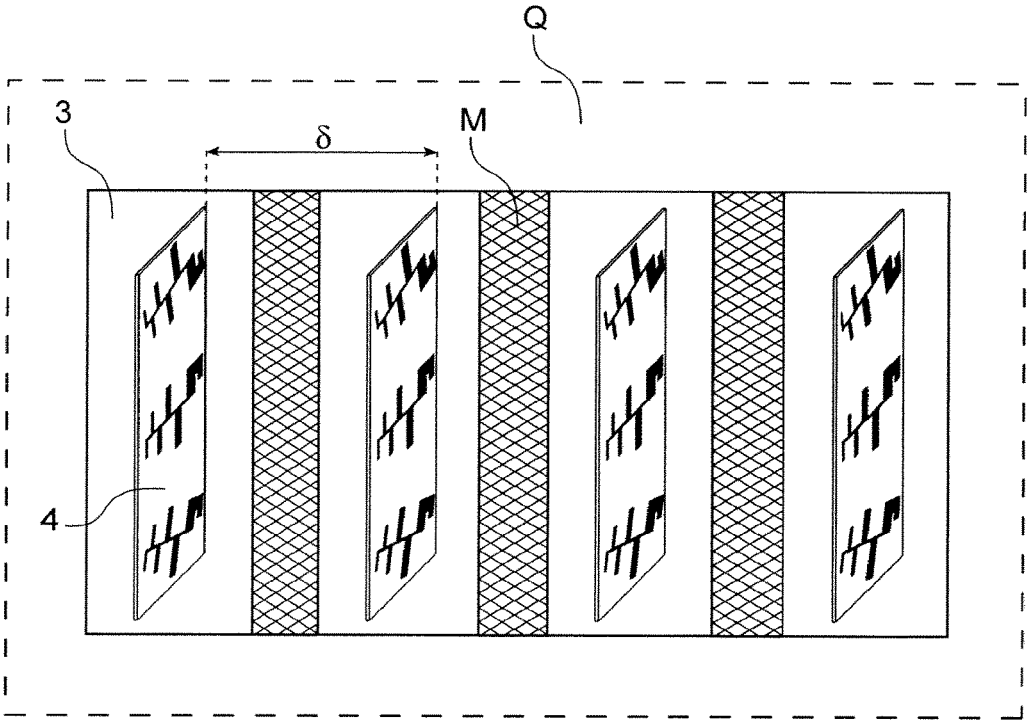
FIG. 9 represents an exemplary arraying of a plurality of wide band log-periodic antennas in accordance with the second embodiment of the invention.

FIG. 9 represents an exemplary arraying of a plurality of wide band log-periodic antennas in accordance with the second embodiment of the invention.

The dielectric substrates 4 of the different log-periodic antennas are parallel to each other, two neighbouring dielectric substrates being separated by a same distance δ. The distance δ is chosen as a function of the operational frequency of the antenna. To that end, means are provided to move nearer or away the different electrically conducting substrates 3. According to an improvement of the second embodiment of the invention, an extensible electrically conducting meshing M is provided between the different substrates 3. This meshing advantageously enables a continuity in the electrical ground to be defined. Regardless of the extension of the meshing M, the size of a unit mesh is much lower than one tenth of the wavelength of the wave radiated by the antenna.

The invention claimed is:

1. A log-periodic antenna, comprising:

at least one set of radiating elements and a flat substrate which defines an electrical ground of the antenna, each set of radiating elements comprising three radiating elements with log-periodic patterns, the radiating elements being positioned above a first face of the flat substrate, each radiating element comprising a rectilinear electrically conducting line and a succession of radiating dipoles distributed on either side of the rectilinear electrically conducting line, perpendicularly to the rectilinear electrically conducting line, the radiating dipoles having a dimension which increases between a first end of the rectilinear electrically conducting line and a second end of the rectilinear electrically conducting line situated nearer to the first face than the first end, a first radiating element among the three radiating elements having a rectilinear electrically conducting line perpendicular to the first face, a second radiating element among the three radiating elements, and a third radiating element among the three radiating elements being situated on either side of the first radiating element, symmetrically to the first radiating element, the first ends of the rectilinear electrically conducting lines of the different radiating elements being separated from each other and aligned along a direction parallel to the first face, the rectilinear electrically conducting line of the second radiating element and the rectilinear electrically conducting line of the third radiating element being situated in a same plane as the rectilinear electrically conducting line of the first radiating element and being each inclined with respect to the rectilinear electrically conducting line of the first radiating element such that the first end of the rectilinear electrically conducting line of the second radiating element and the first end of the rectilinear electrically conducting line of the third radiating element are nearer than the second end of the rectilinear electrically conducting line of the second radiating element and the second end of the rectilinear electrically conducting line of the third radiating element, the radiating dipoles of the three radiating elements being either perpendicular to the plane which contains the rectilinear electrically conducting line of each of the three radiating elements, or in the plane which contains the rectilinear electrically conducting line of the each of the three radiating elements.

2. The log-periodic antenna according to claim 1, wherein:

the distance which separates the radiating dipole with lowest dimensions of the second radiating element from the radiating dipole with lowest dimensions of the first radiating element and the distance which separates the radiating dipole with lowest dimensions of the third radiating element from the radiating dipole with the lowest dimensions of the first radiating element are between $0.6\lambda_{HF}$ and $0.7\lambda_{HF}$, wherein $\lambda_{HF}$ is a wavelength of a high frequency wave radiated by the log-periodic antenna, and the distance which separates the radiating dipole with greatest dimensions of the second radiating element from the radiating dipole with greatest dimensions of the first radiating element and the distance which separates the radiating dipole with greatest dimensions of the third radiating element from the radiating dipole with the greatest dimensions of the first radiating element are between $0.6\lambda_{BF}$ and $0.7\lambda_{BF}$, wherein $\lambda_{BF}$ is a wavelength of a low frequency wave radiated by the log-periodic antenna.

3. The log-periodic antenna according to claim 1, wherein each radiating element comprises log-periodic patterns printed on either side of a flat dielectric substrate.

4. The log-periodic antenna according to claim 3, wherein each radiating element comprises six radiating dipoles positioned between the first end and the second end, the six radiating dipoles being arranged such that, from the first end:

a first radiating dipole of first and second tracks with a length $L\times\tau^5$, τ being a coefficient lower than 1;

a second radiating dipole situated at a distance $D\times\tau^4$ from the first dipole of first and second tracks with a length $L\times\tau^4$;

a third radiating dipole situated at a distance $D\times\tau^3$ from the second dipole of first and second tracks with a length $L\times\tau^3$;

a fourth radiating dipole situated at a distance $D\times\tau^2$ from the third dipole of first and second tracks with a length $L\times\tau^2$;

a fifth radiating dipole situated at a distance $D\times\tau$ from the fourth dipole of first and second tracks with a length $L\times\tau$;

a six radiating dipole situated at a distance D from the fifth dipole of first and second tracks with a length L.

5. The log-periodic antenna according to claim 4, wherein the flat dielectric substrate has a thickness of 0.8 mm and a relative dielectric constant equal to 3, the width of the first and second tracks of the different radiating dipoles being equal to 5 mm, quantities L and D being respectively equal to 70 mm and 15.77 mm and the coefficient τ being equal to 0.824.

6. The log-periodic antenna according to claim 1, further comprising supply means for supplying the first end of the rectilinear electrically conducting line of each radiating element with electromagnetic waves having electric field vectors which have a direction parallel to the axis of the corresponding radiating dipoles.

7. The log-periodic antenna according to claim 6, wherein the supply means comprises a power divider attached to an electrically conducting face of the substrate which is opposite the face above which the radiating elements are situated.

8. The log-periodic antenna according to claim 1, wherein the at least one set of radiating elements comprises at least two sets of radiating elements, and wherein, the radiating dipoles of the three radiating elements of a same set of radiating elements are perpendicular to the plane which contains the rectilinear electrically conducting lines of the three radiating elements, the first faces of the substrates of the different sets of radiating elements are situated in a same plane, the planes which contain the rectilinear electrically conducting lines of the different sets of radiating elements being parallel to each other and the rectilinear electrically conducting lines of the first radiating elements of the different sets of radiating elements being situated in a same plane.

9. The log-periodic antenna according to claim 8, wherein the substrates of two neighbouring sets of radiating elements are electrically connected to each other by an extensible metal meshing enabling the two neighbouring sets of radiating elements to be moved away from each other or nearer to each other.

10. The log-periodic antenna according to claim 1, wherein the at least one set of radiating elements comprises at least two sets of radiating elements, and wherein, the radiating dipoles of the three radiating elements of a same set of radiating elements are in the plane which contains the rectilinear electrically conducting lines of the three radiating elements, the first faces of the substrates of the different sets of radiating elements are situated in a same plane, the planes which contain the rectilinear electrically conducting lines of the different sets of radiating elements are parallel to each other and the rectilinear electrically conducting lines of the first radiating elements of the different sets of radiating elements are situated in a same plane.

* * * * *